US006567630B1

(12) United States Patent
Yamashita

(10) Patent No.: US 6,567,630 B1
(45) Date of Patent: May 20, 2003

(54) IMAGE FORMING DEVICE

(75) Inventor: Toshimi Yamashita, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/060,284

(22) Filed: Feb. 1, 2002

(51) Int. Cl.[7] ..... G03G 21/20
(52) U.S. Cl. ..... 399/93; 399/98
(58) Field of Search ..... 399/93, 98

(56) References Cited

U.S. PATENT DOCUMENTS 5,142,328 A * 8/1992 Yoshida ..... 399/93
6,026,259 A * 2/2000 Yamaki et al. ..... 399/128
6,308,037 B1 10/2001 Yamashita

FOREIGN PATENT DOCUMENTS

JP 62-719972 * 4/1987
JP 3-169315 * 7/1991
JP 3-216677 * 9/1991
JP 09-050206 2/1997

OTHER PUBLICATIONS

U.S. patent application Ser. No. 10/053,676, Yamashita, filed Jan. 24, 2002.
U.S. patent application Ser. No., 09/649,993, Yamashita, filed Aug. 29, 2000.

* cited by examiner

*Primary Examiner*—Quana M. Grainger
(74) *Attorney, Agent, or Firm*—Foley & Lardner

(57) ABSTRACT

The image forming apparatus according to the present invention includes:

a photosensitive drum on which an electrostatic image is formed;

a developing device for developing the electrostatic image by a magnetic toner serving as a visualizing material carried by a developing sleeve, said developing device being located below the center of said photosensitive drum; and a toner spatter prevention sheet provided near said photosensitive drum, having an ozone remover for removing ozone by absorbing and/or decomposing ozone.

7 Claims, 5 Drawing Sheets

IMAGE FORMING DEVICE

FIELD OF THE INVENTION

The present invention relates to an image forming apparatus including a developing device, such as a copying machine, a printer, etc.

BACKGROUND OF THE INVENTION

Conventionally, there are electrophotographic type image forming apparatuses such as copying machines, laser beam printers, etc. A developing device incorporated in an electrophotographic type image forming apparatus uses a two-component developer composed of a carrier and a toner, or a single-component developer composed of only a toner. Generally, a two-component developer is prepared by uniformly agitating a carrier and a toner, and supplied to a developing roller. In addition, there are 1½ component (new two-component type) developers, which are prepared by supplying a small amount of magnetic carrier in the vicinity of a developing roller, and only a magnetic toner is supplied to the developing roller. There is another type of 1½ component developing device, in which a developer prepared by mixing a small amount of magnetic carrier and magnetic toner is supplied in the vicinity of a developing roller, and only the magnetic toner is supplied to the developing roller.

As is well known in the art, in an image forming apparatus employing any of the above-described developing method, a toner spatter prevention sheet is provided to the developing device such that one end of the toner spatter prevention sheet contacts the photosensitive drum, thereby preventing the toner from spattering from the developing device. However, there is a problem in that as the end portion of the toner spatter prevention sheet contacts the drum, striped images (white-striped images and black-striped images) tend to occur.

SUMMARY OF THE INVENTION

The present invention is proposed in view of the above-described problems, and an object of the present invention is to provide an image forming apparatus including means for removing generated ozone, which is capable of preventing the toner from spattering, avoiding such problems as white-striped images and black-striped images, and stably maintaining the image quality for a long time.

The image forming apparatus according to the present invention includes:

- a photosensitive drum on which an electrostatic image is formed;
- a developing device for developing the electrostatic image by a magnetic toner serving as a visualizing material carried by a developing sleeve, said developing device being located below the center of said photosensitive drum; and
- a toner spatter prevention sheet provided near said photosensitive drum, having an ozone remover for removing ozone by absorbing and/or decomposing ozone.

DESCRIPTION OF THE PREFERRED EMBODIMENTS

Figure 1:
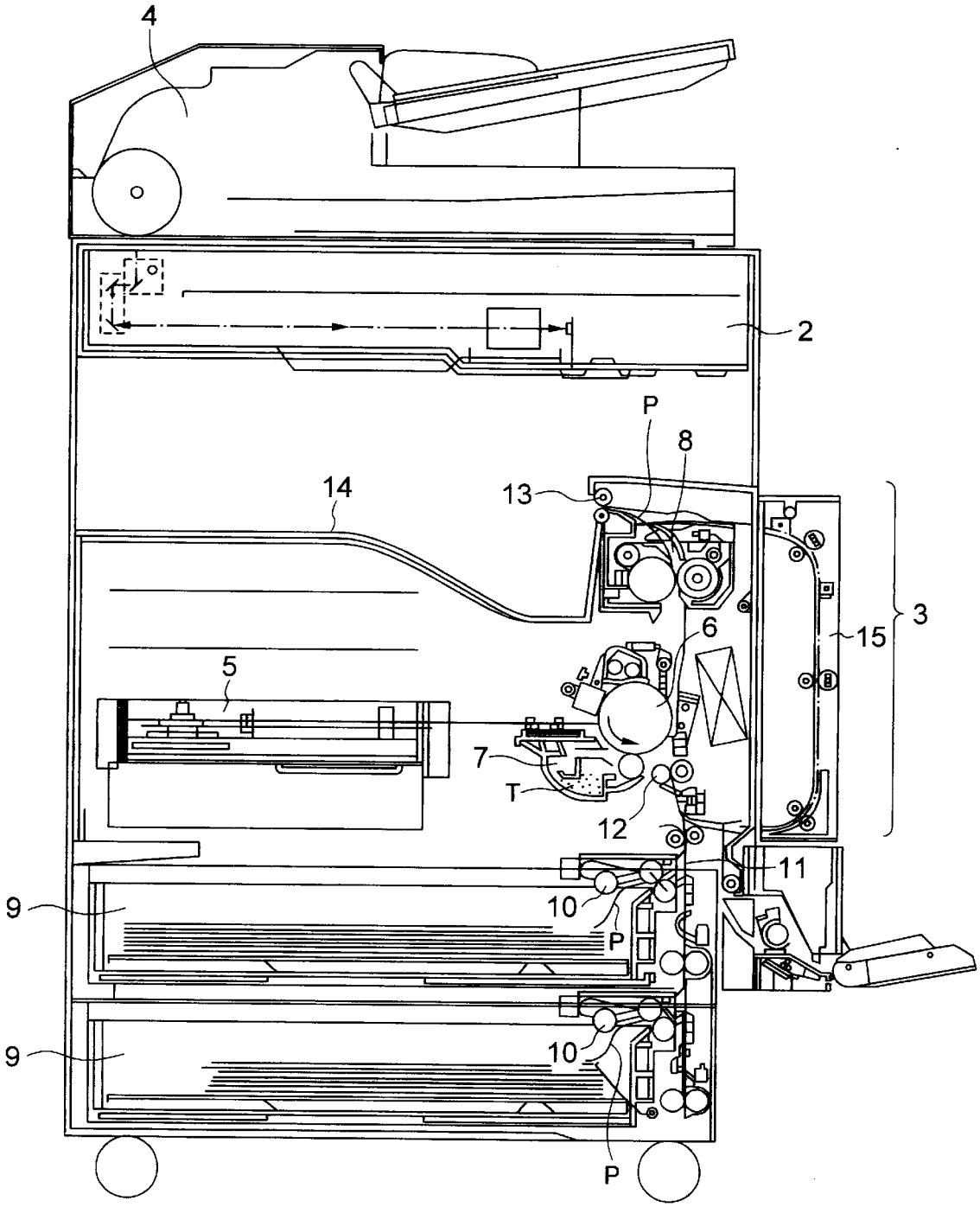
FIG. 1 is a schematic sectional view of a digital copying machine 1, which is an example of image forming apparatus according to the present invention.

FIG. 1 is a schematic sectional view of a digital copying machine 1, which is an example of image forming apparatus according to the present invention.

First, the structure of the digital copying machine 1 will be briefly explained.

As can be understood from FIG. 1, the digital copying machine 1 includes a scanner 2 reading, as the contrast of light, image information of a book or any arbitrary number of sheets of manuscript copies, as the object to be copied, and generates image signals. Further, the digital copying machine 1 includes an image forming section 3 forming an image corresponding to image signals supplied from the scanner 2 or an external device (not shown). The scanner 2 includes an automatic document feeder (ADF) 4, which operates to sequentially send the object to be copied in the form of sheets in accordance with the image reading operation of the scanner 2.

The image forming section 3 includes an exposing device 5 emitting a laser beam corresponding to the image information supplied by the scanner 2 or the external device (not shown), and a photosensitive drum 6 holing an image corresponding to the laser beam as an electrostatic latent image. Moreover, the image forming section 3 includes a developing device 7 supplying a toner T to the image held by the photosensitive drum 6 to develop the image, and a fixing device 8 fixing the toner image transferred from the photosensitive drum 6 to a sheet by the use of heat and pressure.

The operation of the image forming apparatus having the above-described structure will then be described.

An image signal is sent from the scanner 2 or the external device (not shown) to the exposing device 5. Then, a laser beam obtained by modulating the intensity of the image signal is emitted from the exposing device 5 to the photosensitive drum 6, which has been precharged to have a predetermined level of potential, thereby forming an electrostatic latent image corresponding to the image to be copied on the photosensitive drum 6.

Then, a toner T is selectively supplied from the developing device 7 to the photosensitive drum 6 to develop the above-described electrostatic latent image on the photosensitive drum 6. Sheets P, to which the toner image is to be transferred, is fed one by one from a sheet cassette 9 located under the photosensitive drum 6 by a pick-up roller 10. The fed sheet P passes through a carrying passage 11 toward the photosensitive drum 6, and reaches an aligning roller 12 aligning the positions of the toner image (developer image) formed on the photosensitive drum 6 and the sheet P. The sheet P having reached the aligning roller 12 is carried to the transfer position where the photosensitive drum 6 faces a transfer device which will not be described in detail. At the transfer position, the toner image is transferred to the sheet P by the electric field of the transfer device.

The sheet P, on which the toner image is transferred, is carried to a fixing device 8, by which the toner T prepared on the sheet P is heated and melted, thereby being fixed on the sheet P.

The sheet P, on which the toner image was fixed by the fixing device 8, is further carried and fed by a paper ejection roller 13, and ejected to an ejection space (paper ejection tray) 14 between the scanner 2 and the cassette 9. If necessary, a two-side paper feeding device 15 for reversing the sides of the sheet P, on one side of which the image has been fixed, may be provided.

Figure 2:
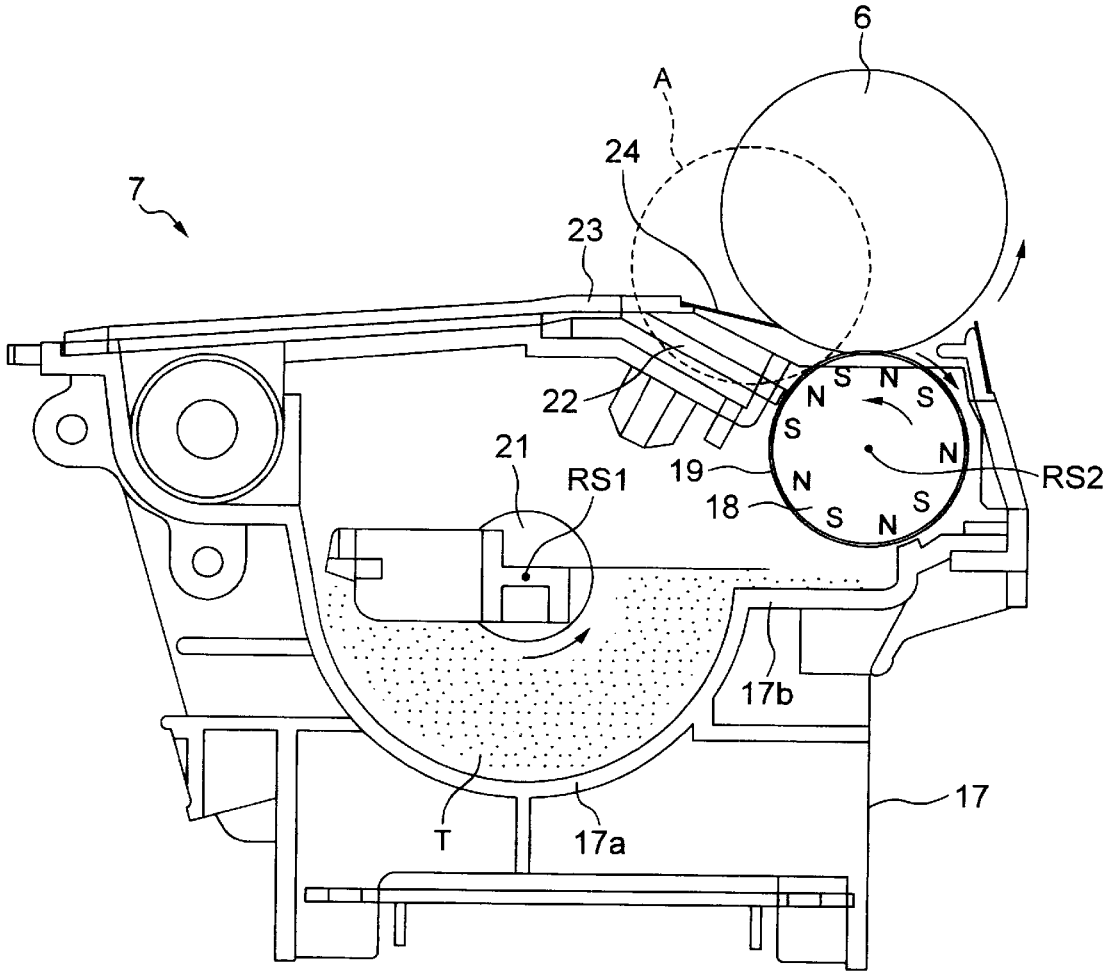
FIG. 2 is an enlarged sectional view specifically showing a developing device 7 incorporated in the digital copying machine 1 shown in FIG. 1.

FIG. 2 is an enlarged sectional view specifically showing the developing device 7 incorporated in the digital copying machine 1 shown in FIG. 1.

First, the structure of the developing device 7 will be described.

As can be understood from FIG. 2, the developing device 7 includes a housing 17. When the developing device 7 is turned on, a toner hopper 17*a* of the housing 17 is filled with a starting agent in which a carrier and a toner T have been mixed in advance. Thereafter, only the toner T as a supplemental agent is supplied to the toner hopper 17*a*. The toner T used here is a magnetic toner composed of particles having the average particle size of 9 m, which include magnetic material particles that gives the magnetism to the toner T. The carrier used here is an Mn—Mg (ferrite) containing carrier composed of particles having the average particle size of 65 m.

A sleeve 19 and a magnet roller 18 inserted thereto are placed at a predetermined position of the housing 17 such that they are rotated reversely relative to each other. That is, in the housing 17, the magnet roller 18, which is rotatable, is provided. The developing sleeve 19, which is rotatable independently of the magnet roller 18, is provided to surround the magnet roller 18. The developing sleeve 19 is 20 mm in diameter, and is adapted to rotate in the same direction as the photosensitive drum 6 at the speed of, for example, 254 mm/s. The magnet roller 18 is adapted to rotate in the direction opposite to that of the developing sleeve 19 at the speed of, for example, 2000 rpm. The length of space between the outer surface of the developing sleeve 19 and the outer surface of the photosensitive drum 6 is about 0.35 mm at the closest part.

The magnet roller 18 includes, for example, 12 poles composed of alternately arranged north poles and south poles, which are arranged in the circumferential direction at substantially regular intervals. The magnetic force of each pole of the magnet roller 18 is about 700 gauss as measured on the surface of the developing sleeve 19.

An agitator 21 agitating the toner T in the toner hopper 17*a* and carrying the toner T toward the developing sleeve 19 is provided in the housing 17. The rotation shaft RS1 of the agitator 21 is located below the rotation shaft RS2 of the developing sleeve 19. In this example, the agitator 21 is adapted to rotate in the same direction as the magnet roller 18.

A blade 22 is provided close to the outer surface of the developing sleeve 19. The blade 22 is for sweeping the surface of a developer layer (toner layer) adhered on the outer surface of the developing sleeve 19 so that the thickness thereof becomes even. The blade 22 is located such that the length of the space between an end portion thereof and the outer surface of the developing sleeve 19 is 0.25 mm at the closest part, and that existence thereof does not effect the rotations of the agitator 21.

A portion of the housing 17 serves as a toner shelf 17*b* connecting the developing sleeve 19 and the toner hopper 17*a*. That is, the toner shelf 17*b* is located below the developing sleeve 19. The toner shelf 17*b* is adapted to increase the adhesion amount of the toner T when it is stirred up by the agitator 21 and adheres to the outer surface of the developing sleeve 19 at the lower portion thereof. That is, the toner shelf 17*b* is adapted to temporarily hold the toner T having been carried by the agitator 21. The toner shelf 17*b* is located below the rotation shaft RS1 of the agitator 21. Further, the horizontal length of the toner shelf 17*b* is equal to or less than the diameter of the developing sleeve 19.

The developing device 7 includes a cover 23. At the tip of the cover 23, a toner spatter prevention sheet 24, of which the tip contacts the photosensitive drum 6, is arranged.

Figure 3:
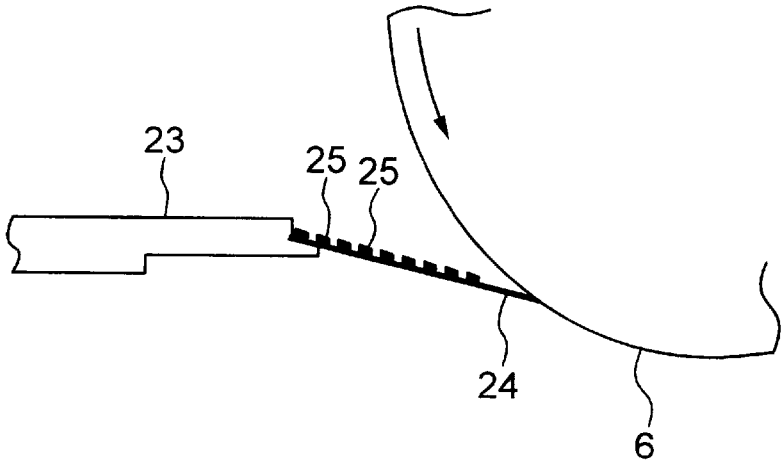
FIG. 3 is an enlarged sectional view of a part indicated by the sign A in FIG. 2.

FIG. 3 is an enlarged detail of a portion in FIG. 2, to which the sign A is assigned. As can be understood from FIG. 3, an ozone remover 25 for removing ozone is applied to the surface of the toner spatter prevention sheet 24, except for an end portion thereof. The reason why the ozone remover 25 is not applied to the end portion of the toner spatter prevention sheet 24 is to prevent damages to the photoreceptor drum 6 by the ozone remover 25. Activated carbon or a catalyst is used as the ozone remover 25. For example, an oxide or peroxide of metal, such as manganese, magnesium, etc. is used as the catalyst. Further, a material which may not cause damage to the photoreceptor drum 6, e.g., an elastic material such as urethane sheet, etc. is used to form the toner spatter prevention sheet 24.

With such a structure in mind, the operation of the developing device 7 will next be described.

As shown in FIG. 2, the toner T agitated by the agitator 21 in the toner hopper 17*a* is carried toward the developing sleeve 19. The carried toner T is adhered to the developing sleeve 19 by the magnetic force of the magnet roller 18. The thickness of the adhered toner T on the surface of the developing sleeve 19 is controlled to become a predetermined value by the blade 22. Then, the electrostatic latent image on the photosensitive drum 6 is realized. As mentioned previously, the toner spatter prevention sheet 24 is provided between the cover 23 and the photosensitive drum 6. Accordingly, the toner T does not spatter outside the developing device 7. AS mentioned previously, the toner T adhered to the photosensitive drum 6 is transferred to paper by the transfer device (not shown), and the (untransferred) toner T (remaining on the photosensitive drum 6) is removed by the cleaning device (not shown). However, depending on the type of the toner or the number of sheets, there is a case where the cleaning device cannot completely remove the toner T, and as the photosensitive drum 6 rotates, the remaining toner T rotates to be adhered to the toner spatter prevention sheet 24. On the other hand, part of the ozone generated at the charged portion near the photosensitive drum 6 is carried near the toner spatter prevention sheet 24 by the air flow in the apparatus, and such ozone is removed by the ozone remover 25 applied on the toner spatter prevention sheet 24. Accordingly, it is not possible that the toner T adhered to the toner spatter prevention sheet 24 is subjected to an ozone product and a little water, thereby reducing the electronic resistance of the toner T, and resulting in that the electric charge of the photosensitive drum 6 is leaked.

Examples of ozone decomposition reaction formula are as follows, where the sign M in the formulas (A) and (B)

denotes metal, and as mentioned previously, the metal oxide and metal peroxide in the left part of the formulas (A) and (B) are catalysts.

(A)

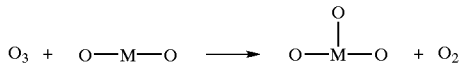

(B)

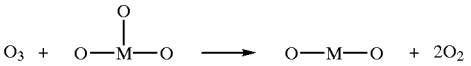

Figure 4:
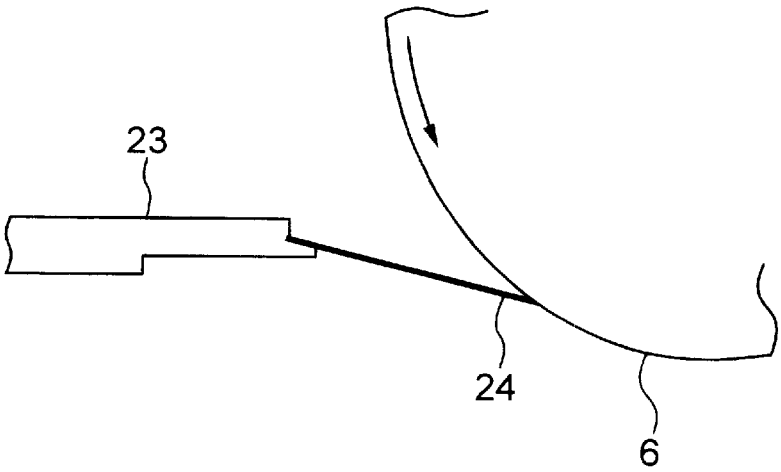
FIG. 4 is a sectional view showing a part of a developing device according to one embodiment by the present inventor corresponding to the part shown in FIG. 3.

FIG. 4 shows a part of a developing device embodied by the present inventor, corresponding to the part shown in FIG. 3. As can be understood from FIG. 4, in this embodiment, no ozone remover is applied to the toner spatter prevention sheet 24.

Figure 5:
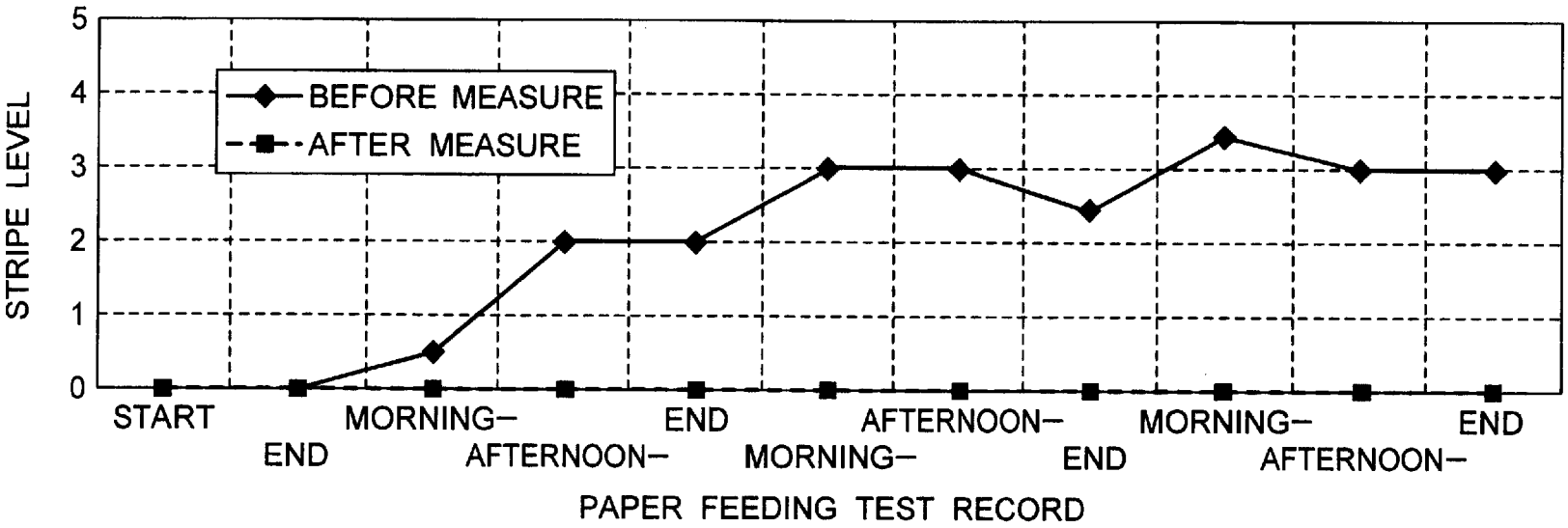
FIG. 5 shows graphs each indicating the result of paper feeding test carried out on an image forming apparatus incorporating a developing device shown in FIG. 3 or 4.
Figure 6:
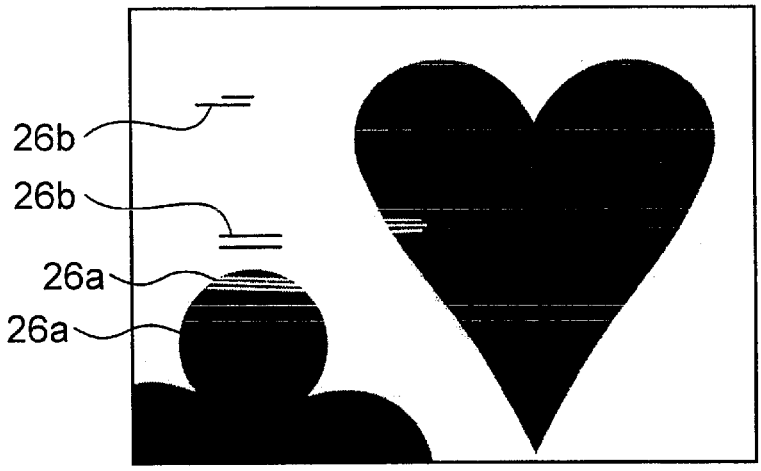
FIG. 6 is a drawing showing white-striped images and black-striped images.

FIG. 5 shows the result of a test (paper feeding test) for checking the stripe level in an image forming apparatus incorporating the developing device shown in FIG. 3 or 4, uniquely carried out for more than three days by the present inventor. The solid line graph shows the result of the paper feeding test executed without applying the ozone remover to the toner spatter prevention sheet 24, i.e., using the developing device shown in FIG. 4. The broken line graph shows the result of the paper feeding test executed by applying the ozone remover to the toner spatter prevention sheet 24, i.e., using the developing device shown in FIG. 3.

As can be understood from FIG. 5, when the paper feeding test was carried out with the ozone remover being applied to the toner spatter prevention sheet 24, the stripe level was "0", i.e., no problem arose as to the image. On the other hand, when the paper feeding test was carried out without applying the ozone remover to the toner spatter prevention sheet, as time lapses, the stripe level became higher, and defects such as the white-striped images 26*a* and the black-striped images 26*b* occurred. Thus, it was verified that a better result can be obtained in the case where the ozone remover is applied to the toner spatter prevention sheet 24.

As described above, according to this embodiment, ozone generated around the photosensitive drum 6 is decomposed by the ozone remover 25 applied to the toner spatter prevention sheet 24. Therefore, no ozone is adhered to the end portion (the portion contacting the photosensitive drum 6) of the toner spatter prevention sheet 24, to which the toner T is applied. Thus, the above-described mechanism prevents the leak of charges of the photosensitive drum 6 due to the decrease in electronic resistance of the toner T. Accordingly, it is possible to obtain an image forming apparatus, which can stably form images without defects such as white-striped images, black-stripe images, etc., for a long time.

Figure 7:
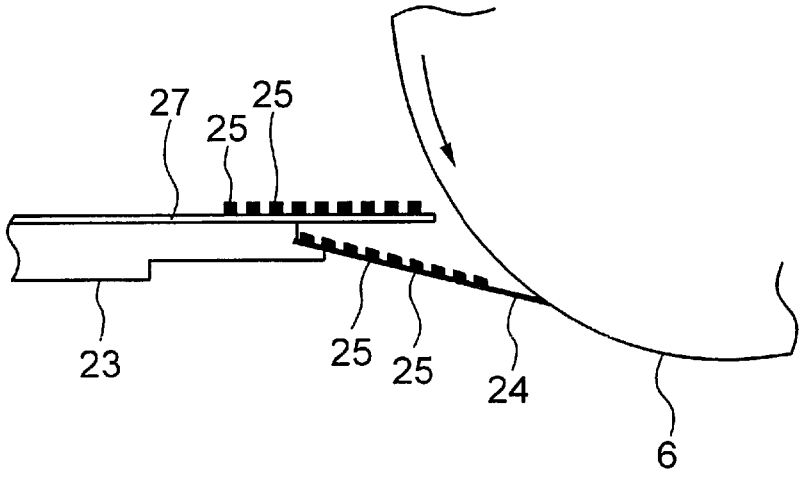
FIG. 7 shows a part of a developing device in another embodiment of the present invention.

FIG. 7 shows a part of a developing device according to another embodiment of the present invention. As can be understood from FIG. 7, in this embodiment, a toner spatter prevention sheet 27 is additionally provided to the cover 23 shown in FIG. 3. This toner spatter prevention sheet 27 will next be described in detail.

As shown in FIG. 7, the toner spatter prevention sheet 27 is attached to the cover 23 upstream from the toner spatter prevention sheet 24. An end portion of the toner spatter prevention sheet 27 projects from the edge of the cover 23 to form a predetermined space with the photosensitive drum 6 in order to prevent damages to the photosensitive drum 6 by the toner spatter prevention sheet 27. The ozone remover 25, which is the same as that used in the previous embodiment, is applied to the surface of the toner spatter prevention sheet 27. However, unlike the previous embodiment, the ozone remover 25 is applied to the surface of the end portion of the toner spatter prevention sheet 27. Further, unlike the previous embodiment, a polyester film, such as Mylar(registered), is used as the material of the toner spatter prevention sheet 27. A paper feeding test was carried out for the developing device with such a structure, and a result equal to or better than that of the previous embodiment was obtained. That is, according to this embodiment, it is possible to obtain an image forming apparatus, which can stably form images without defects such as white-striped images, black-stripe images, etc., for a long time, as in the case of the previous embodiment.

As described above, according to the embodiments of the present invention, ozone around the toner adhered to the toner spatter prevention sheet can be removed, thereby preventing the decrease in electric resistance of the toner. That is, it is possible to prevent the leak of charges of the photosensitive drum caused by the decrease in electric resistance of the toner. Accordingly, it is possible to obtain an image forming apparatus, which can stably form images without defects such as white stripe images, black stripe images, for a long time.

What is claimed is:

1. An image forming apparatus comprising:

a photosensitive member on which an electrostatic image is formed;

a developing device for developing the electrostatic image by a toner serving as a visulalizing material carried by a developing sleeve; and a toner spatter prevention sheet provided near said photosensitive member, having an ozone remover for removing ozone by absorbing and/or decomposing ozone, wherein the end portion of said toner spatter prevention sheet contacts the surface of said photosensitive member, and wherein the ozone remover is applied to the surface of said toner spatter prevention sheet except for a portion contacting said photosensitive member.

2. An image forming apparatus comprising:

a photosensitive member on which an electrostatic image is formed;

a developing device for developing the electrostatic image by a toner serving as a visulalizing material carried by a developing sleeve; and a toner spatter prevention sheet provided near said photosensitive member, having an ozone remover for removing ozone by absorbing and/or decomposing ozone, wherein another toner spatter prevention sheet having an ozone remover is provided at a rotating upstream side of the photosensitive member from the position of said toner spatter prevention sheet.

3. The image forming apparatus according to claim 2, wherein the other toner spatter prevention sheet is formed of a polyester film.

4. The image forming apparatus according to claim 2, wherein the ozone remover of the other toner spatter prevention sheet is at least one of activated carbon absorbing ozone and a catalyst decomposing ozone.

5. An image forming apparatus comprising:

a photosensitive member on which an electrostatic image is formed;

a developing device for developing the electrostatic image by a toner serving as a visulalizing material carried by a developing sleeve; and a toner spatter prevention sheet provided near said photosensitive member, having an ozone remover for removing ozone by absorbing and/or decomposing ozone, wherein the end portion of said toner spatter prevention sheet contacts the surface of said photosensitive member, and wherein another toner spatter prevention sheet having an ozone remover is provided at a rotating upstream side of the photosensitive member from the position of said toner spatter prevention sheet.

6. The image forming apparatus according to claim 5, wherein the other toner spatter prevention sheet is formed of a polyester film.

7. The image forming apparatus according to claim 5, wherein the ozone remover of the other toner spatter prevention sheet is at least one of activated carbon absorbing ozone and a catalyst decomposing ozone.

* * * * *